US010914552B2

(12) United States Patent
Keeney et al.

(10) Patent No.: US 10,914,552 B2
(45) Date of Patent: Feb. 9, 2021

(54) FLASHLIGHT MOUNT FOR A FIREARM

(71) Applicant: Occam Defense Solutions Inc., Moscow, ID (US)

(72) Inventors: Brian Keeney, Moscow, ID (US); Austin Colomaio, Elkland, PA (US); Saulius Puzikas, Jacksonville, TX (US)

(73) Assignee: Occam Defense Solutions Inc., Moscow, ID (US)

( * ) Notice: Subject to any disclaimer, the term of this patent is extended or adjusted under 35 U.S.C. 154(b) by 0 days.

(21) Appl. No.: 16/677,521

(22) Filed: Nov. 7, 2019

(65) Prior Publication Data

US 2020/0232761 A1 Jul. 23, 2020

Related U.S. Application Data

(60) Provisional application No. 62/756,601, filed on Nov. 7, 2018.

(51) Int. Cl.
*F41G 1/35* (2006.01)
*F41G 11/00* (2006.01)

(52) U.S. Cl.
CPC ..... *F41G 1/35* (2013.01); *F41G 11/003* (2013.01)

(58) Field of Classification Search
CPC ..... F41G 1/35; F41G 11/003; F41G 11/004
See application file for complete search history.

(56) References Cited

U.S. PATENT DOCUMENTS

| | | | | |
|---|---|---|---|---|
| 5,628,555 | A | 5/1997 | Sharrah et al. | |
| 6,609,810 | B2 | 8/2003 | Kim | |
| 6,994,449 | B2 | 2/2006 | Kim | |
| 7,134,234 | B1 * | 11/2006 | Makarounis | F41G 11/004 42/146 |
| 7,731,380 | B2 | 6/2010 | Wu | |
| 2007/0193103 | A1 * | 8/2007 | Cheng | F41G 1/35 42/111 |
| 2009/0140015 | A1 | 6/2009 | Faifer | |

* cited by examiner

*Primary Examiner* — Karabi Guharay
(74) *Attorney, Agent, or Firm* — Asgaard Patent Services, LLC; F. Wayne Thompson, Jr.

(57) ABSTRACT

Implementations of a flashlight mount are provided. The flashlight mount is configured to position a flashlight on a handguard of a firearm and includes a trigger mechanism configured to actuate a push-button tailcap switch of the flashlight. In a preferred implementation, a flashlight mount comprises: a base that can be secured to a handguard of a firearm; a flashlight mounting ring configured to releasably hold a flashlight; and a trigger mechanism, the trigger mechanism comprises a bifurcated trigger configured to actuate a push-button tailcap switch of the flashlight when pressed forward. In some implementations, the bifurcated trigger comprises two contact members that extend upwardly and outwardly from a body thereof, thereby positioning each contact member on an opposite side of the handguard. In this way, the trigger mechanism of the flashlight mount is configured to facilitate ambidextrous operation of the flashlight.

15 Claims, 7 Drawing Sheets

FLASHLIGHT MOUNT FOR A FIREARM

CROSS REFERENCE TO RELATED APPLICATION

This application claims the benefit of U.S. Provisional Application Ser. No. 62/756,601, which was filed on Nov. 7, 2018, the entirety of which is incorporated herein by reference.

TECHNICAL FIELD

This disclosure relates to implementations of a flashlight mount for a firearm.

BACKGROUND

Flashlights are used in conjunction with a firearm (e.g., a handgun, a rifle, etc.) to aid in low-light target identification, thereby allowing the operator to simultaneously aim the firearm and illuminate the target. Mounting a flashlight directly to the firearm leaves the operator free to use both hands to operate the weapon. These flashlights are often referred to as weapon mounted lights. Weapon mounted lights are routinely positioned so that any light beam emitted therefrom is parallel to the longitudinal axis of the bore. Most models can be operated by a push-button tailcap switch and/or a remote tape switch connected thereto by a cable.

It can be seen that needs exist for the flashlight mount disclosed herein. It is to the provision of a flashlight mount for a firearm that is configured to address these needs, and others, that the present invention is primarily directed.

SUMMARY OF THE INVENTION

Implementations of a flashlight mount are provided. The flashlight mount is configured to position a flashlight on a handguard of a firearm and includes a trigger mechanism configured to actuate a push-button tailcap switch of the flashlight. In this way, the trigger mechanism can be used to operate the flashlight while it is mounted on the handguard. In some implementations, the trigger mechanism of the flashlight mount is configured to facilitate ambidextrous operation of the flashlight.

In a preferred implementation, a flashlight mount comprises: a base that can be secured to a handguard of a firearm; a flashlight mounting ring configured to releasably hold a flashlight; and a trigger mechanism, the trigger mechanism comprises a bifurcated trigger configured to actuate a push-button tailcap switch of the flashlight when pressed forward.

As another example implementation, a flashlight mount comprises: a base adapted for removably securing a flashlight thereto, the base can be secured to a handguard of a firearm; and a trigger mechanism, the trigger mechanism comprises a bifurcated trigger configured to actuate a push-button tailcap switch of the flashlight when pressed forward.

In some implementations, the bifurcated trigger comprises two contact members that extend upwardly and outwardly from a body thereof, thereby positioning each contact member on an opposite side of the handguard.

BRIEF DESCRIPTION OF THE DRAWINGS

Like reference numerals refer to corresponding parts throughout the several views of the drawings.

DETAILED DESCRIPTION

Figure 1:
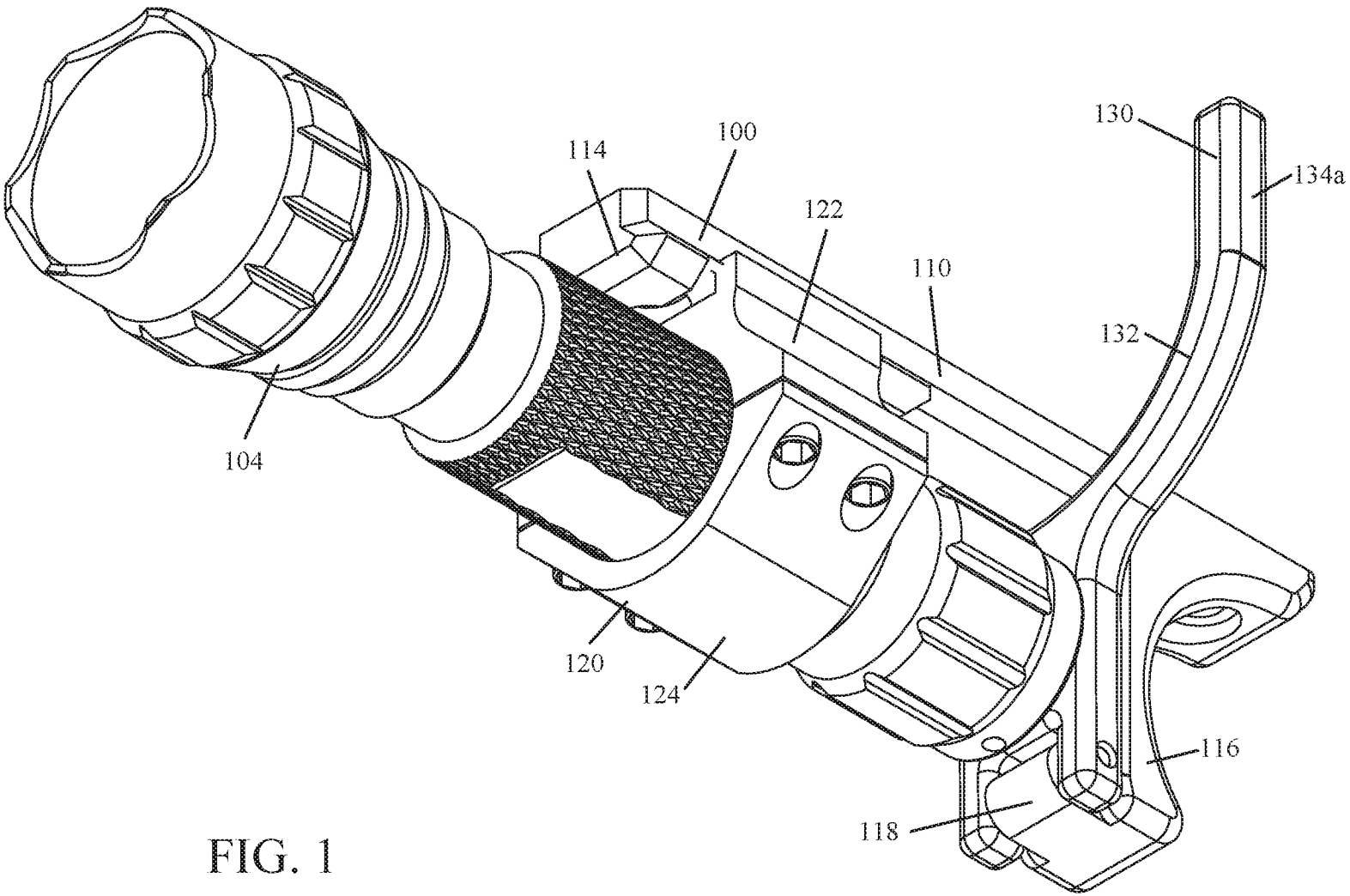
FIGS. 1-4 illustrate a flashlight mount according to the principles of the present disclosure, wherein a flashlight is being held by the flashlight mounting ring.

FIGS. 1-5 illustrate an example implementation of a flashlight mount 100 according to the principles of the present disclosure. The flashlight mount 100 is configured to position a flashlight 104 on a handguard 108 of a firearm 102 and includes a trigger mechanism 130 configured to actuate a push-button tailcap switch 106 of the flashlight 104 (see, e.g., FIG. 8). In this way, the trigger mechanism 130 can be used to operate the flashlight 104 while it is mounted on the handguard 108. In some implementations, the trigger mechanism 130 of the flashlight mount 100 is configured to facilitate ambidextrous operation of the flashlight 104.

As shown in FIGS. 1-5, in some implementations, the flashlight mount 100 comprises a base 110 that can be secured to a handguard for a firearm; a flashlight mounting ring 120 configured to releasably clamp about the exterior of a flashlight 104; and a trigger mechanism 130 configured to actuate a push-button tailcap switch 106 of the flashlight 104.

Figure 8:
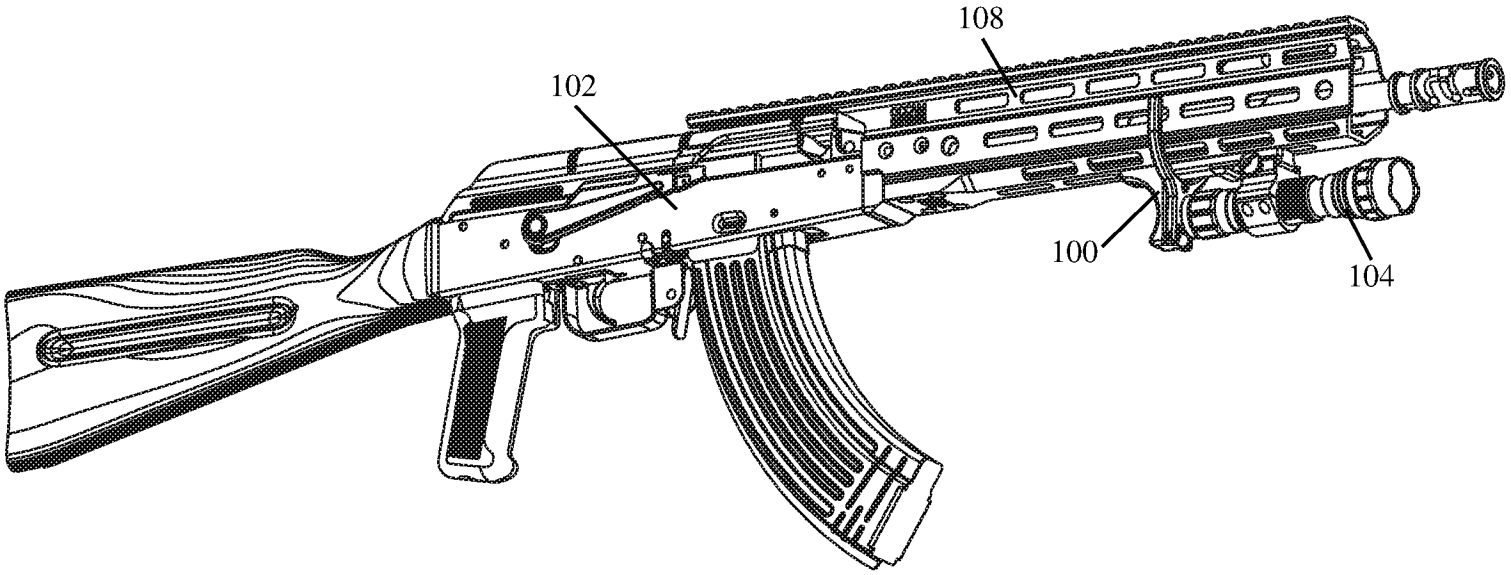
FIG. 8 illustrates the flashlight mount, shown in FIGS. 1-4, secured to the handguard of a rifle.

A shown in FIG. 8, the base 110 is configured to secure the flashlight mount 100 to the handguard 108 of a firearm 102. In some implementations, the base 110 includes a rail interface 114 for removably securing the flashlight mounting ring 120 thereto and a support member 116 for the trigger mechanism 130.

As shown in FIGS. 2 and 6A-6C, a top side 112 of the base 110 is configured so that it can be removably secured to negative space mounting slots conforming to the M-LOK® standard. In this way, the flashlight mount 100 can be secured to the handguard of a firearm. In some implementations, the top side 112 of the base 110 may be configured so that it can be secured to negative space mounting slots conforming to the KeyMod standard, or a MIL-STD-1913 rail interface (i.e., a Pica tinny rail interface).

Figure 2:
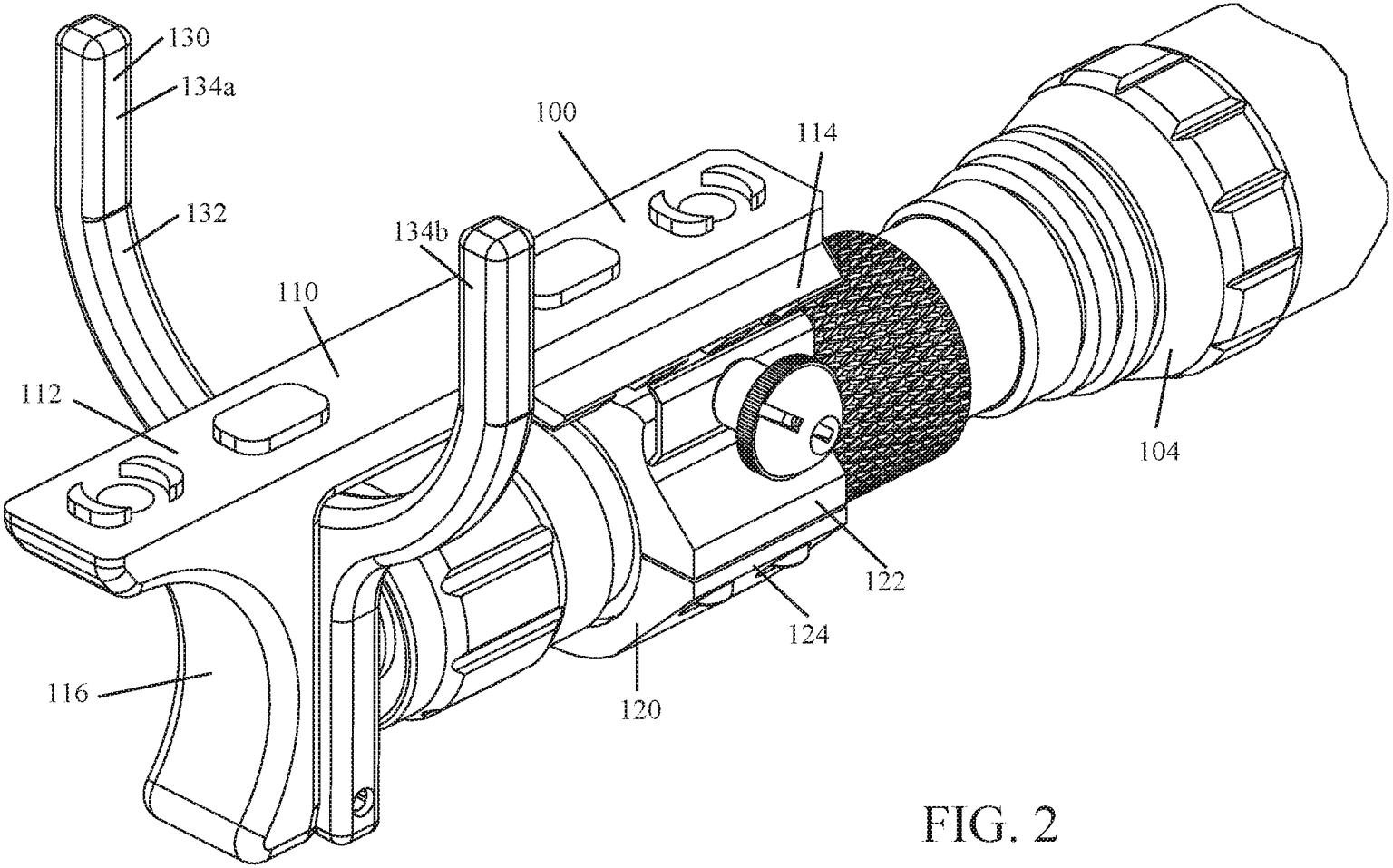
Figure 5:
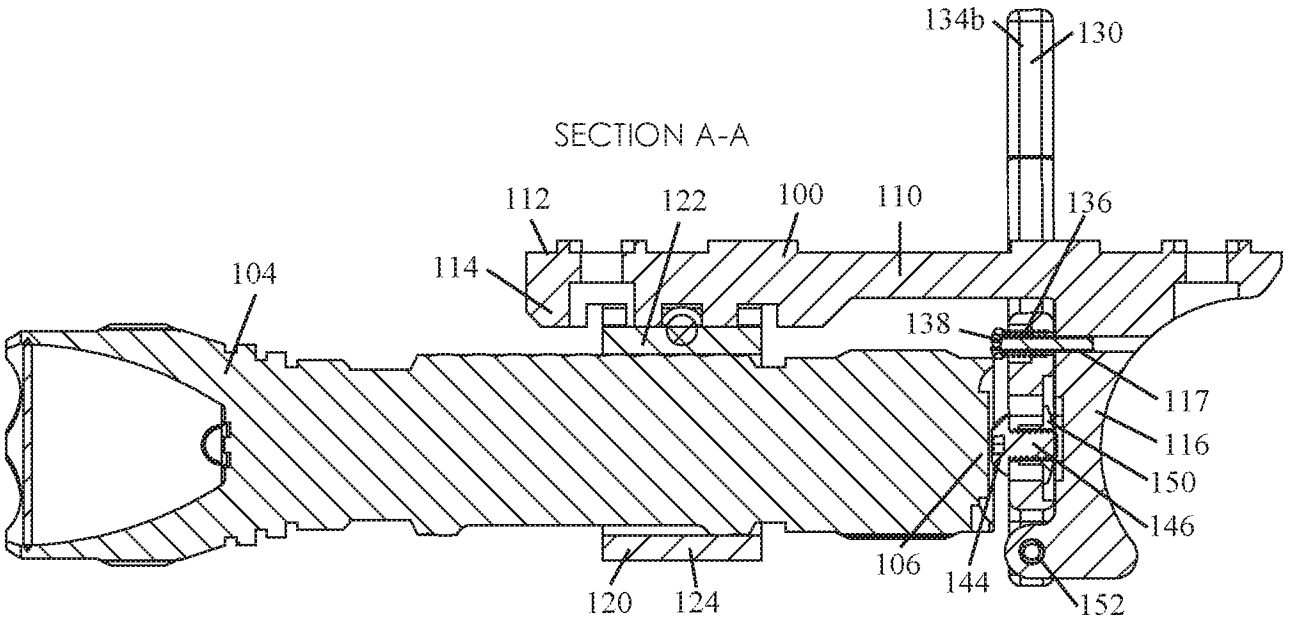
FIG. 5 illustrates a cross-sectional view of the flashlight mount taken along line A-A of FIG. 4.
Figure 4:
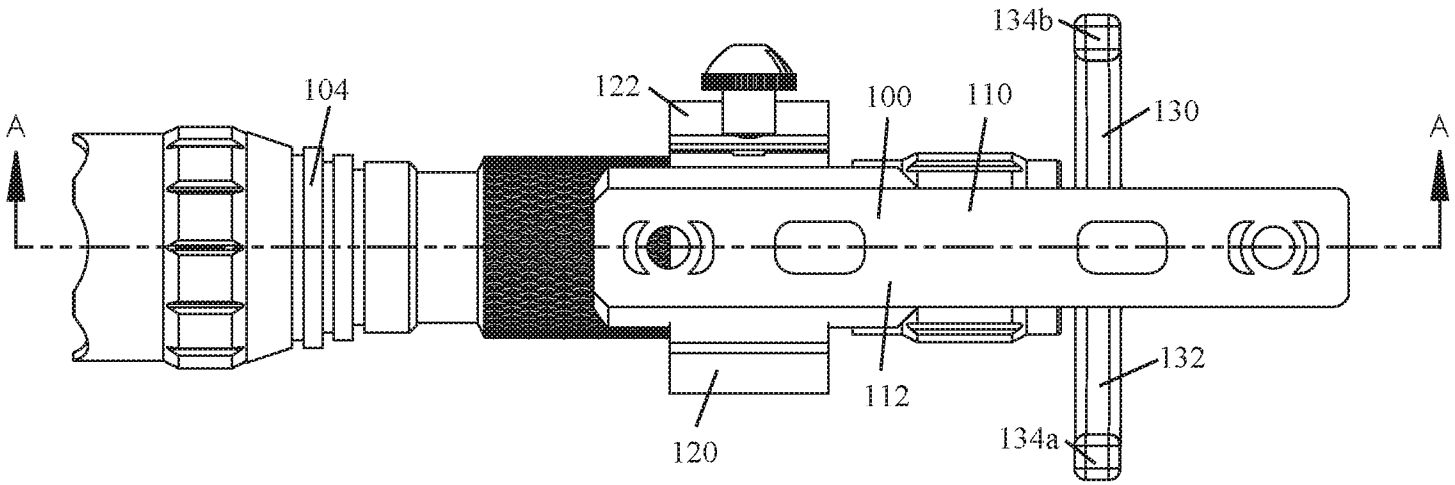
Figure 6C:
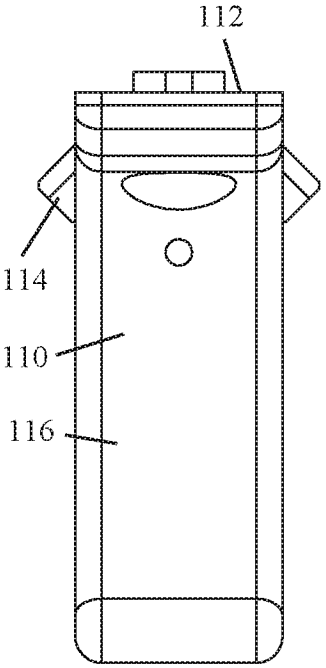
FIG. 6C illustrates a rear view of the base shown in FIG. 6A.
Figure 6B:
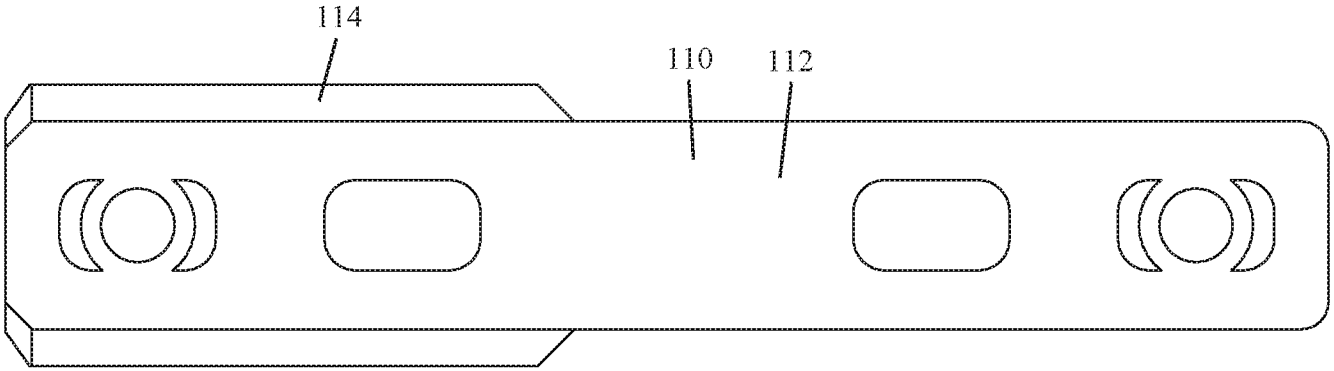
FIG. 6B illustrates a top view of the base shown in FIG. 6A.
Figure 6A:
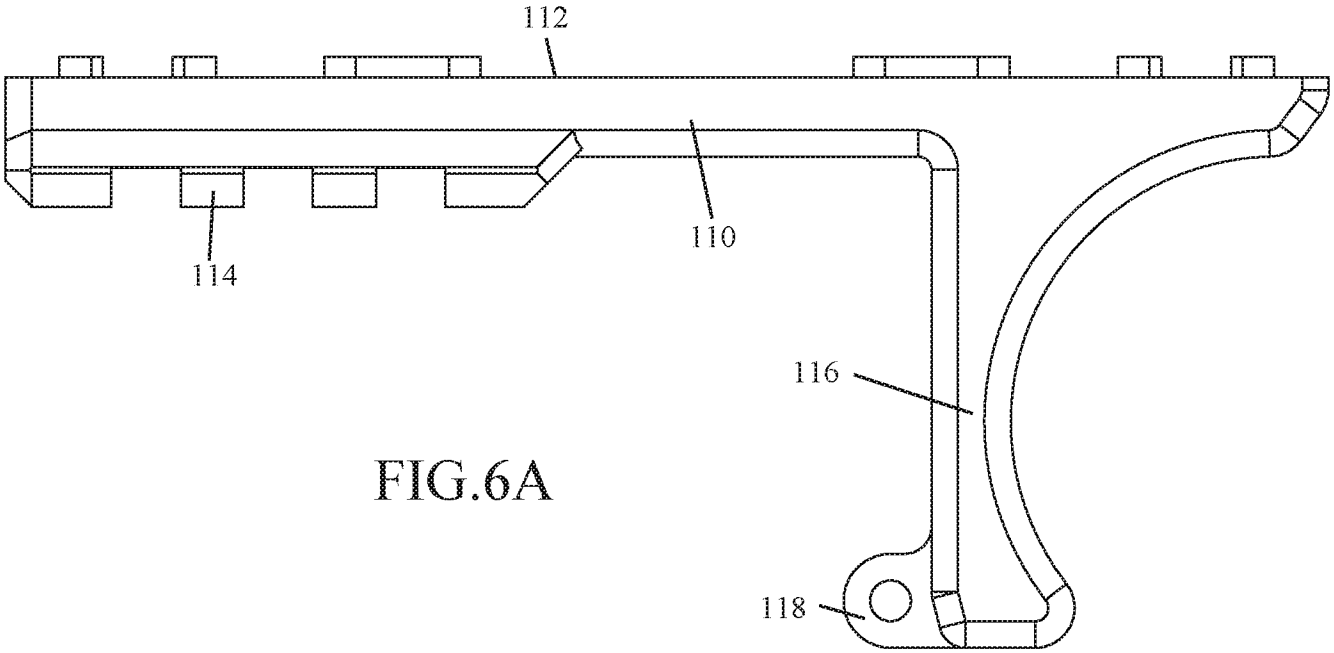
FIG. 6A illustrates a side view of a base for the flashlight mount shown in FIG. 1.

As shown in FIGS. 2, 5, and 6A, the rail interface 114 is a MIL-STD-1913 rail interface positioned adjacent a front end of the base 110. In some implementations, the rail interface 114 may be another firearm accessory interface, known to one of ordinary skill in the art, that is suitable for use as part of a flashlight mount 100.

As shown in FIGS. 1, 5, and 6, in some implementations, the support member 116 extends from the base 110 and includes a threaded bore 117 near its proximal end and a fulcrum 118, for the bifurcated trigger 132 discussed below, on its distal end.

As shown in FIGS. 1-5, the flashlight mounting ring 120 is configured to clamp onto the rail interface 114 of the base 110 and thereby position a flashlight 104 so that it can be actuated by the trigger mechanism 130 of the flashlight mount 100. In some implementations, the flashlight mounting ring 120 may comprise a ring base 122 and a ring cap 124 that are configured to releasably secure about the exterior of the flashlight 104. The ring base 122 is configured to clamp onto the rail interface 114 of the base 110.

Although not shown, in some implementations, the ring base 122 may be an integral portion of the base 110 (i.e., the ring base 122 and the base 110 may be a single unitary piece).

Figure 3:
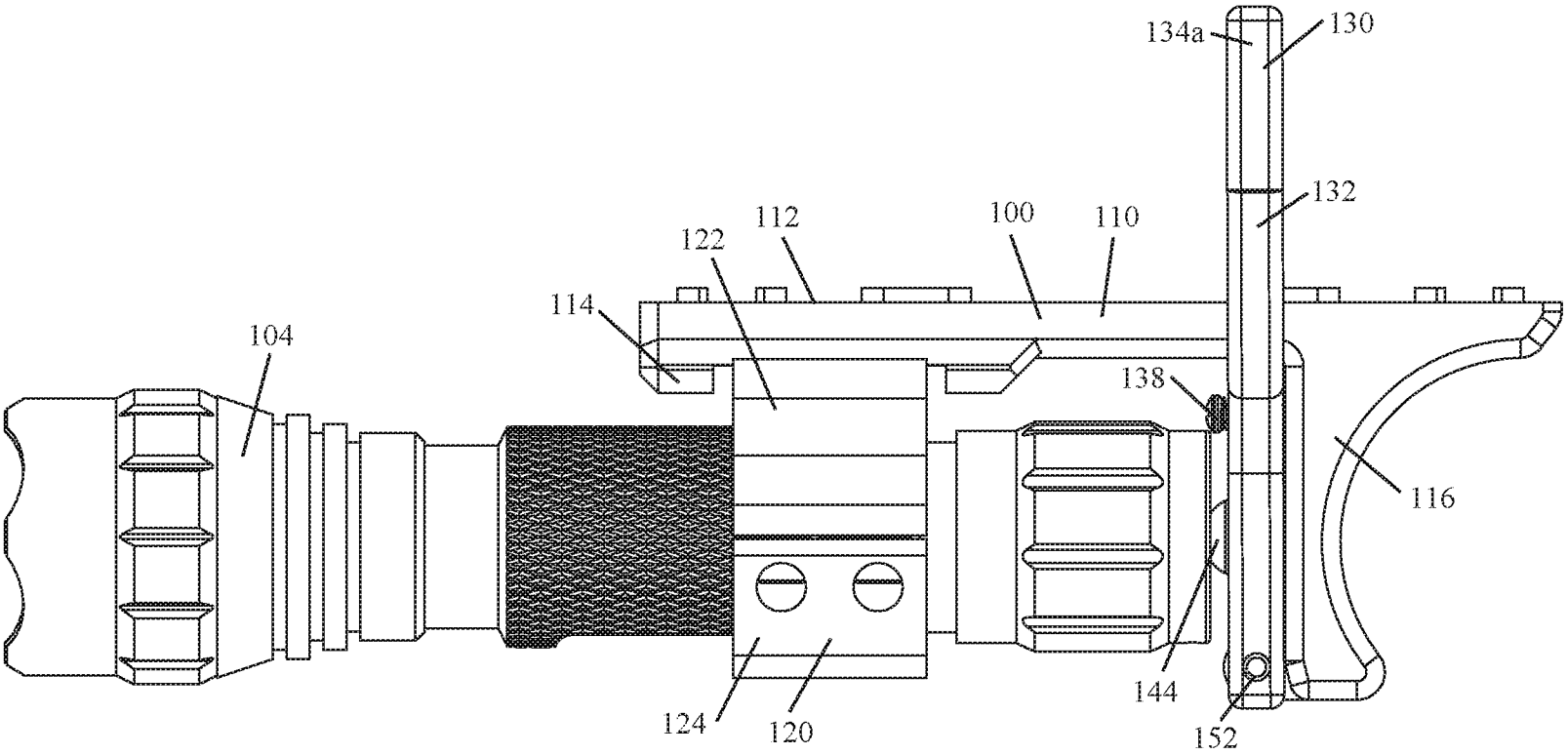

As shown in FIGS. 3 and 5, the trigger mechanism 130 is pivotally mounted on the support member 116 of the base 110. In some implementations, the trigger mechanism 130 comprises a bifurcated trigger 132 that is connected to the fulcrum 118 of the base 110 by a pin 152, or other suitable fastener, on which it pivots. In some implementations, the bifurcated trigger 132 comprises two contact members 134*a*, 134*b* that extend upwardly and outwardly from the body thereof, thereby positioning each contact member 134*a*, 134*b* on an opposite side of the handguard to which the flashlight mount 100 is secured. In this way, since the flashlight 104 may be turned on/off by biasing either contact member 134*a*, 134*b* of the bifurcated trigger 132 forward (i.e., towards the muzzle end of the firearm shown in FIG. 8), the trigger mechanism 130 facilitates ambidextrous operation of the flashlight 104.

Figure 7B:
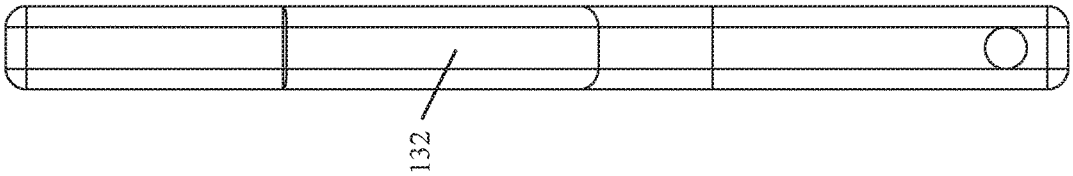
FIGS. 7A and 7B illustrate a bifurcated trigger of the flashlight mount shown in FIG. 1.
Figure 7A:
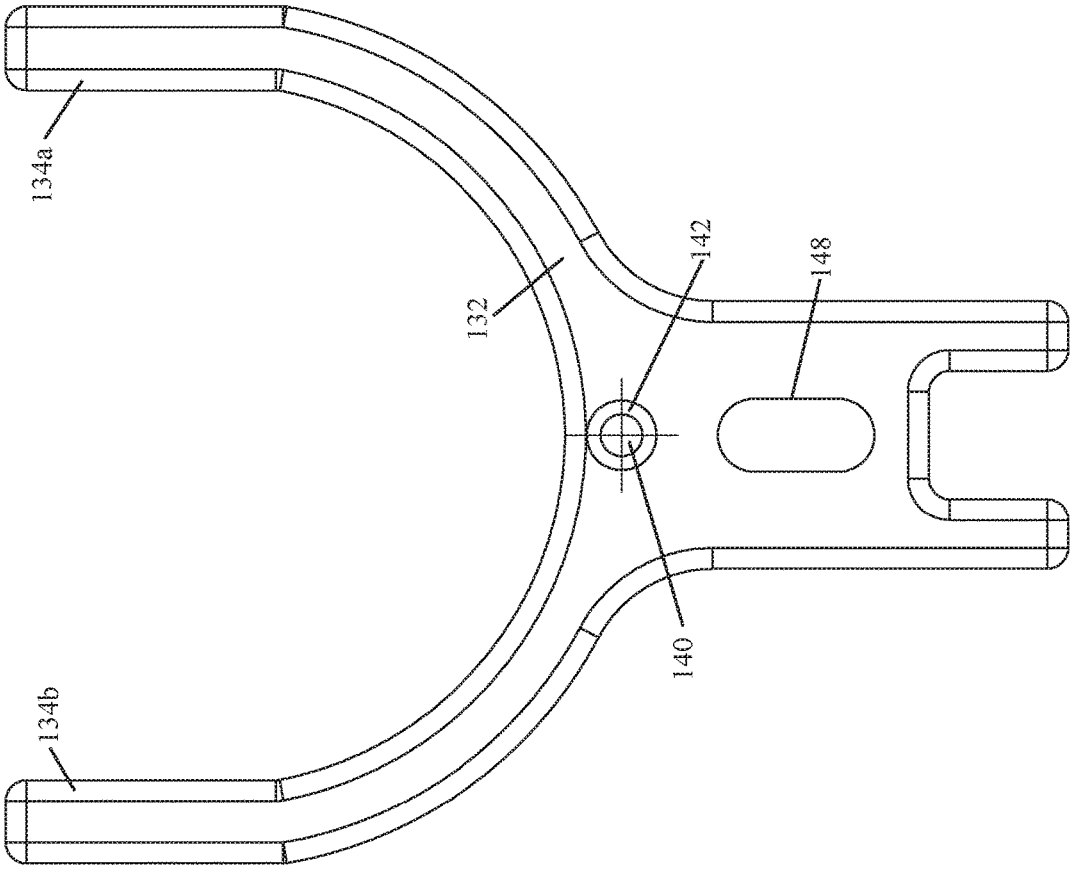

In some implementations, the bifurcated trigger 132 is biased towards the support member 116 by a spring 136 positioned about a fastener 138 that is configured to limit its range of motion. The fastener 138, with the spring 136 positioned thereabout, extends through a first opening 140 in the bifurcated trigger 132 and is threadedly secured within the bore 117 of the support member 116 (see, e.g., FIGS. 5 and 7A). The spring 136 is trapped between the head of the fastener 138 and a counterbore 142 of the first opening 140 in the bifurcated trigger 132. In this way, the spring 136 biases the bifurcated trigger 132 towards the support member 116. In some implementations, the bifurcated trigger's 132 range of motion can be increased by unscrewing the fastener 138 from the threaded bore 117 of the support member 116, and decreased by screwing the fastener 138 further into the threaded bore 117.

As shown in FIGS. 3 and 5, in some implementations, the trigger mechanism 130 further comprises a boss 144 (e.g., a rounded protuberance) that can be aligned, or substantially aligned, with a central axis of the push-button tailcap switch 106 of the flashlight 104. In this way, the flashlight 104 may be turned on/off when a contact member 134*a*, 134*b* of the bifurcated trigger 132 is pressed forward. In some implementations, the boss 144 may be the head of a threaded fastener 146 that can be adjustably positioned (e.g., vertically) on the face of the bifurcated trigger 132. In some implementations, the fastener 146 is threadedly secured to a flanged nut 150 that is slidably received within a slot 148 of the bifurcated trigger 132 (see, e.g., FIGS. 5 and 7A).

In some implementations, the boss 144 of the trigger mechanism 130 can be secured in a desired position by tightening the fastener 146 until the flanged nut 150 no longer slides within the slot 148 of the bifurcated trigger 132.

In some implementations, to reposition the boss 144, the threaded fastener 146 is loosened until the flanged nut 150 is free to slide within the slot 148. Then, the fastener 146 and flanged nut 150 assembly are positioned within the slot 148 so that the boss 144 is located behind the push-button tailcap switch 106 on the rear of the flashlight 104 when secured in that position (see, e.g., FIG. 5). Then, the fastener 146 is tightened until the flanged nut 150 no longer slides within the slot 148 of the bifurcated trigger 132.

Although not shown, in some implementations, the boss 144 may be an elastomer piece that is secured to the head of the threaded fastener 146.

In some implementations, the base 110, the flashlight mounting ring 120, the bifurcated trigger 132, or a combination thereof, is made of a metal alloy (e.g., an aluminum alloy). In some implementations, the base 110, the flashlight mounting ring 120, the bifurcated trigger 132, or a combination thereof, can be made of a suitable plastic material known to one of ordinary skill in the art.

In an alternate implementation of the flashlight mount 100, the base 110 may be adapted for removably securing a flashlight 104 (e.g., a Surefire® Scout Light®) thereto without the use of a flashlight mounting ring 120, or another intermediate mount.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A flashlight mount for a flashlight having a push-button tailcap switch, the flashlight mount comprising:

a base that can be secured to a handguard of a firearm;

a flashlight mounting ring configured to releasably hold the flashlight; and a trigger mechanism, the trigger mechanism comprises a bifurcated trigger configured to actuate the push-button tailcap switch of the flashlight when pressed forward.

2. The flashlight mount of claim 1, wherein the bifurcated trigger comprises two contact members that extend upwardly and outwardly from a body thereof, thereby positioning each contact member on an opposite side of the handguard.

3. The flashlight mount of claim 2, wherein the bifurcated trigger further comprises a boss that is substantially aligned with the push-button tailcap switch of the flashlight.

4. The flashlight mount of claim 1, wherein the base includes a support member for the trigger mechanism, the support member extends from the base and includes a fulcrum for the bifurcated trigger.

5. The flashlight mount of claim 4, wherein the bifurcated trigger comprises two contact members that extend upwardly and outwardly from a body thereof, thereby positioning each contact member on an opposite side of the handguard.

6. The flashlight mount of claim 5, wherein the bifurcated trigger further comprises a boss that is substantially aligned with the push-button tailcap switch of the flashlight.

7. A flashlight mount for a flashlight having a push-button tailcap switch, the flashlight mount comprising:

a base adapted for removably securing the flashlight thereto, the base can be secured to a handguard of a firearm; and a trigger mechanism, the trigger mechanism comprises a bifurcated trigger configured to actuate the push-button tailcap switch of the flashlight when pressed forward.

8. The flashlight mount of claim 7, wherein the bifurcated trigger comprises two contact members that extend upwardly and outwardly from a body thereof, thereby positioning each contact member on an opposite side of the handguard.

9. The flashlight mount of claim 8, wherein the bifurcated trigger further comprises a boss that is substantially aligned with the push-button tailcap switch of the flashlight.

10. The flashlight mount of claim 7, wherein the base includes a support member for the trigger mechanism, the support member extends from the base and includes a fulcrum for the bifurcated trigger.

11. The flashlight mount of claim 10, wherein the bifurcated trigger comprises two contact members that extend upwardly and outwardly from a body thereof, thereby positioning each contact member on an opposite side of the handguard.

12. The flashlight mount of claim 11, wherein the bifurcated trigger further comprises a boss that is substantially aligned with the push-button tailcap switch of the flashlight.

13. A flashlight mount for a flashlight having a push-button tailcap switch, the flashlight mount comprising:

a base that can be secured to a handguard of a firearm, the base includes a support member, the support member depends from the base and includes a fulcrum on its distal end;

a flashlight mounting ring configured to releasably hold the flashlight; and a trigger mechanism, the trigger mechanism comprises a bifurcated trigger that is connected to the fulcrum of the support member by a pin on which it pivots, the bifurcated trigger is configured to actuate the push-button tailcap switch of the flashlight when pressed forward.

14. The flashlight mount of claim 13, wherein the bifurcated trigger comprises two contact members that extend upwardly and outwardly from a body thereof, thereby positioning each contact member on an opposite side of the handguard.

15. The flashlight mount of claim 14, wherein the bifurcated trigger further comprises a boss that is substantially aligned with the push-button tailcap switch of the flashlight.

* * * * *